US008703674B2

(12) United States Patent
Umehara et al.

(10) Patent No.: US 8,703,674 B2
(45) **Date of Patent: *Apr. 22, 2014**

(54) LUBRICATING OIL COMPOSITION

(75) Inventors: Kazuhiro Umehara, Tokyo (JP); Kenji Yamamoto, Tokyo (JP)

(73) Assignee: Adeka Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/577,721

(22) PCT Filed: Mar. 24, 2011

(86) PCT No.: PCT/JP2011/057182

§ 371 (c)(1),
(2), (4) Date: Aug. 8, 2012

(87) PCT Pub. No.: WO2011/118707

PCT Pub. Date: Sep. 29, 2011

(65) Prior Publication Data

US 2012/0309656 A1 Dec. 6, 2012

(30) Foreign Application Priority Data

Mar. 26, 2010 (JP) ..... 2010-071432

(51) Int. Cl.
*C10M 137/10* (2006.01)
*C07F 9/02* (2006.01)

(52) U.S. Cl.
USPC ..... 508/423; 558/162

(58) Field of Classification Search
USPC ..... 508/423; 558/162
See application file for complete search history.

(56) References Cited

U.S. PATENT DOCUMENTS

| | | | | |
|---|---|---|---|---|
| 3,492,373 | A | 1/1970 | Matson et al. | |
| 4,800,030 | A | 1/1989 | Kaneko et al. | |
| 5,344,468 | A | 9/1994 | Hanlon et al. | |
| 5,560,849 | A * | 10/1996 | Shankwalkar et al. | 508/423 |
| 6,245,725 | B1 * | 6/2001 | Tanaka et al. | 508/365 |
| 2003/0171227 | A1 | 9/2003 | Holt et al. | |

FOREIGN PATENT DOCUMENTS

| | | |
|---|---|---|
| EP | 0 612 837 | 8/1994 |
| EP | 1 013 749 | 6/2000 |
| JP | 62-156188 | 7/1987 |
| JP | 62-156198 | 7/1987 |
| JP | 5-194559 | 8/1993 |
| JP | 7-207290 | 8/1995 |
| JP | 2003-183247 | 7/2003 |
| JP | 2004-501234 | 1/2004 |
| JP | 2008-174742 | 7/2008 |
| JP | 2008-189936 | 8/2008 |
| JP | 2008-239763 | 10/2008 |
| WO | 96/20263 | 7/1996 |

OTHER PUBLICATIONS

International Search Report issued Jun. 21, 2011 in International (PCT) Application No. PCT/JP2011/057182, of which the present application is the national stage.
Supplementary European Search Report dated Nov. 6, 2013 issued in corresponding European Application No. 11759512.4.

* cited by examiner

*Primary Examiner* — Vishal Vasisth
(74) *Attorney, Agent, or Firm* — Wenderoth, Lind & Ponack, L.L.P.

(57) ABSTRACT

Provided is a lubricating oil composition, including a base oil and a specific condensed phosphate blended with various additives.

5 Claims, No Drawings

LUBRICATING OIL COMPOSITION

This application is a 371 of PCT/JP2011/057182, filed Mar. 24, 2011.

TECHNICAL FIELD

The present invention relates to a lubricating oil composition, in particular, a lubricating oil composition to which a large amount of a condensed phosphate can be added.

BACKGROUND ART

Machines such as automobiles and machine tools have become more sophisticated in functionality in recent years, and performance required for a lubricating oil to be used in such machines has also become more sophisticated. Although various functions and effects are required for the lubricating oil, an extremely high degree of performance concerning wear prevention has been required for the lubricating oil because the speeds and pressures of the machines have been increasing. An anti-wear agent is typically added as an additive to the lubricating oil for the wear prevention. Such anti-wear agent is an additive that has been well known from long past, and a phosphorus- or sulfur-based compound, or a combination of these compounds has generally been used for the wear prevention (see, for example, Patent Documents 1 to 3).

For example, Patent Document 1 discloses a diesel engine oil for an engine with an exhaust gas recirculation apparatus, the oil being characterised in that a lubricating oil base oil (a mineral oil or a synthetic oil) is blended with 5.8 to 8.3 mass % of a calcium alkyl salicylate (6.0 mass % of calcium (Ca) content) having a total basic number (TBN) of 165 mg KOH/g as a detergent, 0.09 to 0.13 mass % in terms of sine (Zn) of a primary alkyl-type zinc dithiophosphate as an antioxidant-cum-anti-wear agent, and 0.02 to 0.04 mass % in terms of molybdenum (Mo) of an oil-soluble oxymolybdenum dialkyl dithiophosphate as a friction modifier-cum-anti-wear agent.

In addition, Patent Document 2 discloses an anti-wear agent for a low-phosphorus lubricant formed of a composition having the following chemical structure:

[Chem. 1]

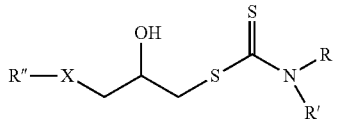

[where R and R' may each represent hydrogen or an alkyl group, and in this case, at least one of R and R' represents an alkyl group, and R" represents an alkyl group, R'''$OCOCH_2$, or R'''$OCOCH_2CH_2$ (where R''' represents an alkyl group and X represents S)].

Further, Patent Document 3 discloses a super tractor oil universal lubricating composition characterized in that:

(a) the lubricating composition contains an oil of lubricating viscosity having a viscosity index of at least about 95 and blending additive components containing (i) at least one metal detergent, (ii) at least one phosphorus-based anti-wear agent, and (iii) at least one oil-soluble molybdenum compound;

(b) the ratio between a metal content (ppm) based on the total weight of the lubricating composition and the total basic number (mg KOH/g) of the lubricating composition is about 210 to about 450 (ppm/mg KOH/g);

(c) the ratio between the metal content (ppm) based on the total weight of the lubricating oil composition and a phosphorus content (ppm) based on the total weight of the lubricating composition is about 5.0 to about 20.0 (ppm/ppm); and (d) the ratio between the phosphorus content (ppm) based on the total weight of the lubricating composition and a molybdenum content (ppm) based on the total weight of the lubricating composition is about 0.5 to about 80.0 (ppm/ppm).

In addition, the applicant of the present application has already proposed that the use of a condensed phosphate can exert a higher wear-preventing effect than that of a con vent tonally known phosphorus-based anti-wear agent (Japanese Patent Application No. 2010-21022).

PRIOR ART DOCUMENT

Patent Document

Patent Document 1: JP 07-207290 A

Patent Document 2: JP 2003-18324 A

Patent Document 3: JP 2008-174742 A

SUMMARY OF THE INVENTION

Problem to be Solved by the Invention

However, studies recently conducted by the inventors of the present invention have revealed the following. The condensed phosphate may show low solubility in a lubricating oil base oil serving as a base. As a result, insoluble matter is precipitated and hence the addition amount of the phosphate is limited in some cases. Accordingly, the phosphate may be unable to exert a sufficient effect.

Therefore, an object of the present invention is to provide a lubricating oil composition whose wear-preventing effect can be additionally improved by the following. In consideration of the fact that a problem such as the precipitation of insoluble matter may occur when a large amount of a condensed phosphate is added to a lubricating oil base oil (base oil), the solubility of the condensed phosphate is improved so that a large amount of the condensed phosphate can be added to the lubricating oil base oil.

Means for Solving the Problem

The inventors of the present invention have intensively studied in order to solve the problem, and as a result, the present invention has been achieved.

That is, the present invention is a lubricating oil composition, including: the following component (A) and component (B); and one or two or more kinds selected from the following component (C), component (D), component (E), and component (F):

Component (A): a base oil;

Component (B): a compound represented by the following general formula (1):

[Chem. 2]

(1)

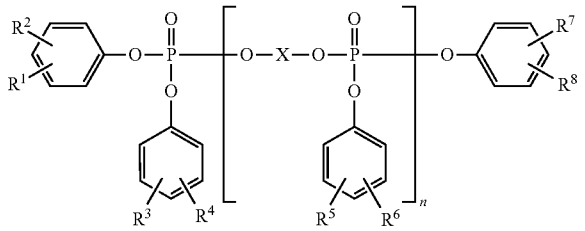

where $R^1$ to $R^8$ each independently represent a hydrogen atom or an alkyl group having 1 to 20 carbon atoms, X represents a hydrocarbon group having 2 to 20 carbon atoms, and n represents a number from 1 to 10;

Component (C): a compound represented by the following general formula (2):

[Chem. 3]

(2)

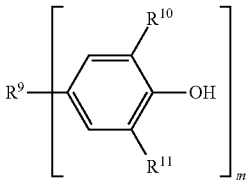

where $R^9$ represents a hydrocarbon group having 1 to 30 carbon atoms, and the hydrocarbon group may be interrupted with an ether group, a sulfide group, a ketone group, an ester group, a carbonate group, an amide group, or an imino group, $R^{10}$ and $R^{11}$ each represent an alkyl group having 1 to 20 carbon atoms, and m represents a number from 1 to 4;

Component (D): a compound represented by the following general formula (3):

[Chem. 4]

(3)

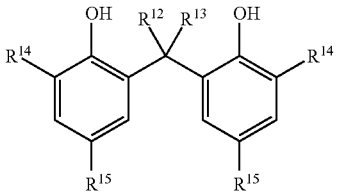

where $R^{12}$ and $R^{13}$ each independently represent a hydrogen atom or an alkyl group having 1 to 20 carbon atoms, $R^{14}$ represents an alkyl group having 1 to 6 carbon atoms or a cycloalkyl group having 6 carbon atoms, and $R^{15}$ represents an alkyl group having 1 to 20 carbon atoms;

Component (E): a compound represented by the following general formula (4):

[Chem. 5]

(4)

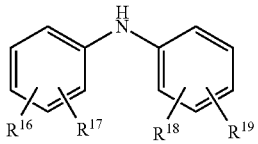

where $R^{16}$ to $R^{19}$ each independently represent a hydrogen atom, or an alkyl group having 1 to 20 carbon atoms; and Component (F): a compound represented by the following general formula (5):

[Chem. 6]

(5)

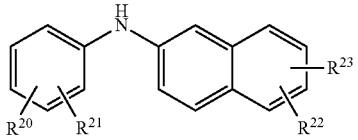

where $R^{20}$ to $R^{23}$ each independently represent a hydrogen atom or an alkyl group having 1 to 20 carbon atoms.

Effects of the Invention

An effect of the present invention lies in the provision of a lubricating oil composition wherein a larger amount of a condensed phosphate can be added to the lubricating oil composition than that in the case of a lubricating oil composition containing the condensed phosphate whose addition amount has been conventionally limited in some oases, and as a result, its wear-preventing effect can be additionally improved.

BEST MODE FOR CARRYING OUT THE INVENTION

In a lubricating oil composition of the present invention, a base oil that can be used as component (A) is exemplified by a mineral oil, a synthetic oil, and a mixture thereof. More specific examples thereof include: synthetic oils such as a poly-α-olefin, an ethylene-α-olefin copolymer, a polybutene, an alkylbenzene, an alkylnaphthalene, a polyalkylene glycol, a polyphenyl ether, an alkyl-substituted diphenyl ether, a polyol ester, an aromatic ester, a hindered ester having a pentaerythritol skeleton, a dibasic ester, a carbonate, a silicone oil, a fluorinated oil, and gas to liquids (GTLs); a paraffin-based mineral oil, a naphthene-based mineral oil, and purified mineral oils obtained by purifying these mineral oils. Those base oils may be used each alone or may be used as a mixture. Of those base oils, because of their high wear-improving effects, a poly-α-olefin, an ethylene-α-olefin copolymer, a polybutene, an alkylbenzene, an alkylnaphthalene, an aromatic ester, a hindered ester, a dibasic ester, a paraffin-based mineral oil, a naphthene-based mineral oil, and GTLs are preferred, a poly-α-olefin, an aromatic ester, a hindered ester, a dibasic ester, a paraffin-based mineral oil, a naphthene-based mineral oil, and GTLs are more preferred, and an aromatic ester, a dibasic ester, a paraffin-based mineral oil, a naphthene-based mineral oil, and a poly-α-olefin are still more preferred.

When a poly-α-olefin is used, the poly-α-olefin is derived from at least one selected from α-olefins each having 8 to 20 carbon atoms and has a kinematic viscosity at 100° C. of 1 to 300 $mm^2$/sec. In addition, a preferred ethylene-α-olefin copolymer is as described below. The ethylene-α-olefin copolymer contains a constitutional unit derived from at least one selected from α-olefins each having 8 to 20 carbon atoms at a content of 50 to 99 mass % and a constitutional unit derived from ethylene at a content of 1 to 50 mass %, and has a kinematic viscosity at 100° C. from 1 to 300 $mm^2$/sec. In addition, the mineral oil is more preferably as described below. The mineral oil is subjected to purification such as hydrogenation purification, solvent deasphalting, solvent extraction, solvent dewaxing, contact dewaxing, hydrocracking, sulfuric acid washing, or a clay treatment, and has a kinematic viscosity at 100° C. from 1 to 50 $mm^2$/sec. A kinematic viscosity of the base oil at 100° C. in excess of 300 $mm^2$/sec is not preferred because its low-temperature viscosity characteristic may deteriorate. A kinematic viscosity of less than 1 $mm^2$/sec is not preferred because the formation of an oil film at a lubrication site is insufficient and hence lubricity may be poor or the extent of metal wear may enlarge. In addition, when the mineral oil is used as the base oil, its viscosity index is preferably 90 or more, more preferably 100 or more.

Component (B) is a compound represented by general formula (1).

[Chem. 7]

(1)

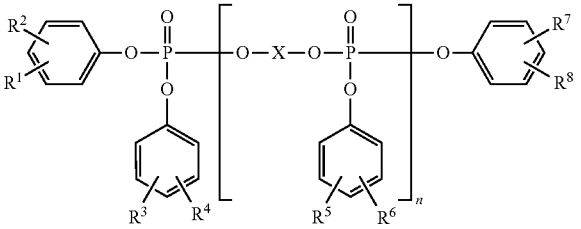

$R^1$ to $R^8$ in the compound represented by the general formula (1) each independently represent a hydrogen atom or an alkyl group having 1 to 20 carbon atoms. Examples of an alkyl group include a methyl group, an ethyl group, a propyl group, an isopropyl group, a butyl group, an isobutyl group, a secondary butyl group, a tertiary butyl group, a pentyl group, an amyl group, an isoamyl group, a hexyl group, a heptyl group, an isoheptyl group, an octyl group, an isooctyl group, a 2-ethylhexyl group, a nonyl group, an isononyl group, a decyl group, a dodecyl (lauryl) group, a tridecyl group, a tetradecyl (myristyl) group, a pentadecyl group, a hexadecyl (palmityl) group, a heptadecyl group, an octadecyl group (stearyl) group, a nonadecyl group, and an icosyl group. $R^1$ to $R^8$ each represent preferably a hydrogen atom or a methyl group, more preferably a hydrogen atom because a wear-preventing effect is high.

X in the general formula (1) represents a hydrocarbon group having 2 to 20 carbon atoms, and examples of such group include an alkylene group, a cycloalkylene group, and a hydrocarbon group containing one or more arylene groups. Examples of the alkylene group include an ethylene group, a propylene group, a butylene group, a pentylene group, a hexylene group, a heptylene group, an octylene group, a nonylene group, a decylene group, an undecylene group, a dodecylene group, a tetradecylene group, a hexadecylene group, an octadecylene group, and an icosalene group. Examples of the cycloalkylene group include a cyclopropylene group, a cyclobutylene group, a cyclopentylene group, a cyclohexylene group, a cycloheptylene group, a cyclooctylene group, a dicyclopentylene group, and a tricyclopentylene group.

Examples of the hydrocarbon group containing one or more arylene groups include groups represented by general formula (6), general formula (7), and general formula (8), a 1,2-diphenylethylene group, and a naphthylene group. In the case of a group represented by the general formula (6), three structures, i.e., an ortho body, a meta body, and a para body are obtained depending on bonding sites. Any one of the structures is permitted, and the structural difference does not lead to a change in performance. X preferably represents a group containing one or more aryl groups out of those groups because the wear-preventing effect is high. X represents more preferably a group represented by any one of general formula (6), general formula (7), and general formula (3), still more preferably a group represented by one of general formula (6) and general formula (7), most preferably the group represented by general formula (6).

[Chem. 8]

(6)

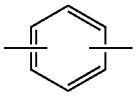

(7)

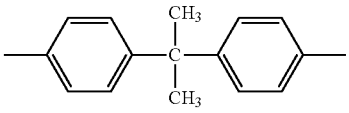

(8)

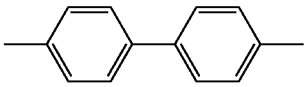

n of the compound represented by the general formula (1) represents its degree of polymerisation, and n is a number from 1 to 10, preferably a number from 1 to 5 in order that the component (B) of the lubricating oil composition of the present invention may be made to sufficiently exert its wear-preventing effect.

It should be noted a compound where n of the compound represented by the general formula (1) is zero or a compound where n is 11 or more are included as impurities in the component (B) in some cases. The content of such impurities is preferably 10 parts by mass or less, more preferably 5 parts by mass or less, still more preferably 2 parts by mass or less with respect to 100 parts by mass of the component (B) of a product of the present invention. A content in excess of 10 parts by mass is not preferred because it reduces the wear-preventing effect of the lubricating oil composition of the present invention.

In addition, the average of n, i.e., an average degree of polymerization is calculated from, the molar ratio of the compound represented by the general formula (1). In the case of, for example, a composition where the molar ratio of a compound in which n=1 is 50 mol % and the molar ratio of a compound in which n=2 is 50 mol %, the average degree of polymerization is 1.5. It should be noted that a value for n can be calculated from the result of high-performance liquid chromatography measurement.

The average of n of the compound represented by the general formula (1) as the component (B), i.e., the average degree of polymerization, which is not particularly limited, is preferably 1.0 to 4.0 in order that the wear-preventing effect may be improved, and is more preferably 1.0 to 2.0. An average degree of polymerization in excess of 4.0 is not preferred because the component may be hard to dissolve in the base oil or the wear-preventing effect may be reduced. It should be noted that when compounds where n in the general formula (1) is zero or where n is 11 or more is included, a value for n of such compounds is not factored into the calculation of the average of n of the component (B) of the present invention, i.e., the average degree of polymerisation.

Any one of the known methods may be employed as a method of producing the compound represented by the general formula (1), and the target product can be obtained by, for example, one of the following methods.

Method 1

When a compound is produced wherein X is represented by the general formula (6), all of $R^1$ to $R^8$ represent hydrogen atoms, and the value for n in the general formula (1) is 1 to 5, said compound can be obtained by reacting 1 mol of 1,3-benzenediol with 2 mol of phosphorus oxychloride, and then, reacting the obtained product with 4 mol of phenol. In this case, compounds having different values for n can be produced by changing the molar ratio of each raw material. At whatever molar ratio the synthesis may be performed, a mixture of compounds having different values for n is typically obtained unless purification is performed.

Method 2

When a compound is produced wherein X is represented by the general formula (6), all of $R^1$ to $R^8$ represent hydrogen atoms, and the value for n in the general formula (1) is 1, said compound can be obtained by reacting 1 mol of 1,3-benzenediol with 2 mol of diphenyl chlorophosphate.

In the lubricating oil composition of the present invention, the solubility of the component (B) in the component (A) can be improved by blending one or two or more kinds selected from component (C), component (D), component (E) and component (F) as compared with that in the case where only component (A) and component (B) are blended. Of components (C), (D), (E) and (F), components (C), (E) and (F) are preferably used.

Component (C) is a compound represented by general formula (2).

[Chem. 9]

(2)

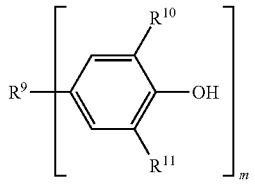

In the compound, $R^9$ represents a hydrocarbon group having 1 to 30 carbon atoms. The hydrocarbon group may be interrupted with an ether group, a sulfide group, a ketone group, an ester group, a carbonate group, an amide group, or an imino group. Examples of the hydrocarbon group which does not contain an ether group, a sulfide group, a ketone group, an ester group, a carbonate group, an amide group, or an imino group include a monovalent hydrocarbon group, a divalent hydrocarbon group, a trivalent hydrocarbon group, and a tetravalent hydrocarbon group. Examples of the monovalent hydrocarbon group include an alkyl group, an alkenyl group, a cycloalkyl group, and an aryl group. Examples of the alkyl group include the alkyl groups given as examples for the general formula (1), a pentacosyl group, and a triacontyl group.

Examples of the alkenyl group include a vinyl group, a 1-methylethenyl group, a 2-methylethenyl group, a propenyl group, a butenyl group, an isobutenyl group, a pentenyl group, a hexenyl group, a heptenyl group, an octenyl group, a decenyl group, a pentadecenyl group, an octadecenyl group, an icosenyl group, and a triacontenyl group.

Examples of the cycloalkyl group include a cyclohexyl group, a cyclopentyl group, a cycloheptyl group, a methylcyclopentyl group, a methylcyclohexyl group, a methylcycloheptyl group, a cyclopentenyl group, a cyclohexenyl group, a cycloheptenyl group, a methylcyclopentenyl group, a methylcyclohexenyl group, and a methylcycloheptenyl group.

Examples of the aryl group include a phenyl group, a naphthyl group, a 2-methylphenyl group, a 3-methylphenyl group, a 4-methylphenyl group, a 4-vinylphenyl group, a 3-isopropylphenyl group, a 4-isopropylphenyl group, a 4-butylphenyl group, a 4-isobutylphenyl group, a 4-tertiary butylphenyl group, a 4-hexylphenyl group, a 4-cyclohexylphenyl group, a 4-octylphenyl group, a 4-(2-ethylhexyl)phenyl group, and a 4-dodecylphenyl group.

Examples of the divalent hydrocarbon group include a methylene group, an ethylene group, a propylene group, a butylene group, a pentylene group, a hexylene group, a heptylene group, an octylene group, a nonylene group, a decylene group, a dodecylene group, a tridecylene group, a tetradecylene group, a pentadecylene group, a hexadecylene group, a heptadecylene group, an octadecylene group, a nonadecylene group, and an icosylene group.

$R^9$ may be interrupted with an ether group, a sulfide group, a ketone group, an ester group, a carbonate group, an amide group, or an imino group, and one or two or more of these groups may be incorporated into the same molecule. Specific examples of the group that interrupts $R^9$ include groups represented by the following general formulae (9) to (16). Of those, a group represented by the general formula (10), a group represented by the general formula (11), a group represented by the general formula (12), a group represented by the general formula (13), and/or a group represented by the general formula (14) each having an ester group or an amide group are/is preferred, and the group represented by the general formula (10) and/or the group represented by the general formula (11) are/is more preferred.

[Chem. 10]

$$-(R^A)_p-\underset{\underset{O}{\|}}{C}-R^B- \quad (9)$$

(In the formula, p represents 0 or 1, and $R^A$ and $R^B$ each represent a hydrocarbon group.)

[Chem. 11]

$$-(R^A)_p-\underset{\underset{O}{\|}}{C}-O-R^B- \quad (10)$$

(In the formula, p represents 0 or 1, and $R^A$ and $R^B$ each represent a hydrocarbon group.)

[Chem. 12]

$$—(R^A)_p—O—\underset{\underset{O}{\|}}{C}—R^B— \quad (11)$$

(In the formula, p represents 0 or 1, and $R^A$ and $R^B$ each represent a hydrocarbon group.)

[Chem. 13]

$$—(R^A)_p—O—\underset{\underset{O}{\|}}{C}—O—R^B— \quad (12)$$

(In the formula, p represents 0 or 1, and $R^A$ and $R^B$ each represent a hydrocarbon group.)

[Chem. 14]

$$—(R^A)_p—\underset{\underset{H}{|}}{N}—\underset{\underset{O}{\|}}{C}—R^B— \quad (13)$$

(In the formula, p represents 0 or 1, and $R^A$ and $R^B$ each represent a hydrocarbon group.)

[Chem. 15]

$$—(R^A)_p—\underset{\underset{O}{\|}}{C}—\underset{\underset{H}{|}}{N}—R^B— \quad (14)$$

(In the formula, p represents 0 or 1, and $R^A$ and $R^B$ each represent a hydrocarbon group.)

$$—(R^C)_q—O—R^D— \quad (15)$$

(In the formula, q represents 0 or 1, and $R^C$ and $R^D$ each represent a hydrocarbon group.)

$$—(R^C)_q—S—R^D— \quad (16)$$

(In the formula, q represents 0 or 1, and $R^C$ and $R^D$ each represent a hydrocarbon group.)

In addition, $R^{10}$ and $R^{11}$ each represent an alkyl group having 1 to 20 carbon atoms, and examples thereof include the alkyl groups given as examples for the general formula (1), and m represents a number from 1 to 4.

More specific examples of those components (C) include compounds represented by the following respective general formulae (17) to (21) and 4,4'-isopropylidenebis(2,6-di-t-butylphenol). The compounds represented by the respective general formulae (17) to (21) are preferred because of their high improving effects on the solubility of the component (B), and the compound represented by each of the general formula (17) and the general formula (20) is more preferred.

[Chem. 16]

(17)

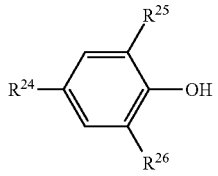

(In the formula, $R^{24}$ represents an alkyl group having 1 to 20 carbon atoms, and $R^{25}$ and $R^{26}$ each independently represent an alkyl group having 1 to 4 carbon atoms.)

It should be noted that $R^{24}$ in the compound represented by the general formula (17), which represents an alkyl group having 1 to 20 carbon atoms as described above, preferably represents an alkyl group having 1 to 18 carbon atoms because the improving effect on the solubility of the component (B) is high, and the number of carbon atoms is more preferably 1 to 4, still more preferably 1. $R^{25}$ and $R^{26}$, which each independently represent an alkyl group having 1 to 4 carbon atoms, each preferably represent an alkyl group having 4 carbon atoms because the solubility of the compound represented by the general formula (17) is high.

[Chem. 17]

(18)

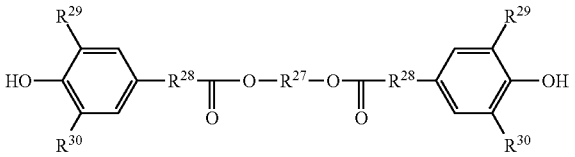

(In the formula, $R^{27}$ represents an alkylene group having 1 to 10 carbon atoms, $R^{28}$ represents an alkylene group having 1 to 9 carbon atoms, and $R^{29}$ and $R^{30}$ each independently represent an alkyl group having 1 to 4 carbon atoms.)

It should be noted that $R^{27}$ in the compound represented by the general formula (18), which represents an alkylene group having 1 to 10 carbon atoms as described above, preferably represents an alkylene group having 1 to 8 carbon atoms because the improving effect on the solubility of the component (B) is high, and the number of carbon atoms is more preferably 4 to 8, still more preferably 5 to 7, $R^{28}$ which represents an alkylene group having 1 to 9 carbon atoms, preferably represents an alkylene group having 2 to 4 carbon atoms because the improving effect on the solubility of the component (B) is high, and the number of carbon atoms is more preferably 2. $R^{29}$ and $R^{30}$, which each independently represent an alkyl group having 1 to 4 carbon atoms, each preferably represent an alkyl group having 4 carbon atoms because the solubility of the compound represented by the general formula (18) is high.

[Chem. 18]

(19)

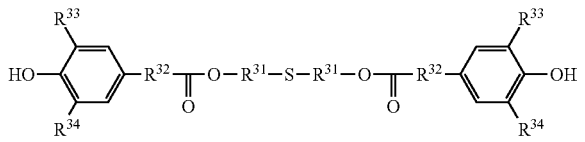

(In the formula, $R^{31}$ represents an alkylene group having 1 to 9 carbon atoms, $R^{32}$ represents an alkylene group having 1 to 9 carbon atoms, and $R^{33}$ and $R^{34}$ each independently represent an alkyl group having 1 to 4 carbon atoms.)

It should be noted that $R^{31}$ in the compound represented by the general formula (19), which represents an alkylene group having 1 to 9 carbon atoms as described above, preferably represents an alkylene group having 1 to 8 carbon atoms because the improving effect on the solubility of the component (B) is high, and the number of carbon atoms is more preferably 1 to 6, still more preferably 1 to 3. $R^{32}$, which represents an alkylene group having 1 to 9 carbon atoms, preferably represents an alkylene group having 2 to 4 carbon atoms because the improving effect on the solubility of the component (B) is high, and the number of carbon atoms is more preferably 2. $R^{33}$ and $R^{34}$, which each independently represent an alkyl group having 1 to 4 carbon atoms, each preferably represent an alkyl group having 4 carbon atoms because the solubility of the compound represented by the general formula (19) is high.

[Chem. 19]

(20)

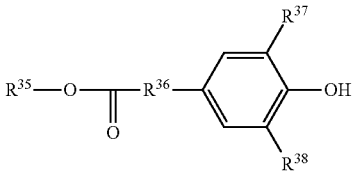

(In the formula, $R^{35}$ represents an alkyl group having 1 to 24 carbon atoms, $R^{36}$ represents an alkyl group having 1 to 5 carbon atoms, and $R^{37}$ and $R^{38}$ each independently represent an alkyl group having 1 to 4 carbon atoms.)

It should be noted that $R^{35}$ in the compound represented by the general formula (20), which represents an alkyl group having 1 to 24 carbon atoms as described above, preferably represents an alkyl group having 1 to 22 carbon atoms because the improving effect on the solubility of the component (B) is high, and the number of carbon atoms is more preferably 1 to 18, still more preferably 7 to 18. $R^{36}$, which represents an alkylene group having 1 to 5 carbon atoms, preferably represents an alkylene group having 2 to 4 carbon atoms because the improving effect on the solubility of the component (B) is high, and the number of carbon atoms is more preferably 2, $R^{37}$ and $R^{38}$, which each independently represent an alkyl group having 1 to 4 carbon atoms, each preferably represent an alkyl group having 4 carbon atoms because the solubility of the compound represented by the general formula (20) is high.

[Chem. 20]

(21)

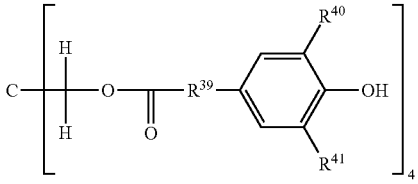

(In the formula, $R^{39}$ represents an alkylene group having 1 to 5 carbon atoms, and $R^{40}$ and $R^{41}$ each independently represent an alkyl group having 1 to 4 carbon atoms.)

It should be noted that $R^{39}$ in the general formula (21), which represents an alkylene group having 1 to 5 carbon atoms as described above, preferably represents an alkylene group having 2 to 4 carbon atoms because the improving effect on the solubility of the component (B) is high, and the number of carbon atoms is more preferably 2. $R^{40}$ and $R^{41}$, which each independently represent an alkyl group having 1 to 4 carbon atoms, each preferably represent an alkyl group having 4 carbon atoms because the solubility of the compound represented by the general formula (21) is high.

Component (D) is a compound represented by general formula (3).

[Chem. 21]

(3)

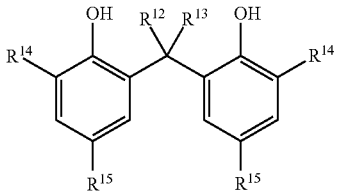

In the compound, $R^{12}$ and $R^{13}$ each independently represent a hydrogen atom or an alkyl group having 1 to 20 carbon atoms, and examples thereof include the alkyl groups given as examples for the compound represented by the general formula (1). $R^{12}$ and $R^{13}$ each preferably represent a hydrogen atom or an alkyl group having 1 to 4 carbon atoms because the improving effect on the solubility of the component (B) is high, and each more preferably represent a hydrogen atom. $R^{14}$ represents an alkyl group having 1 to 6 carbon atoms or a cycloalkyl group having 6 carbon atoms, and examples thereof include the alkyl groups given as examples for the compound represented by the general formula (1) and a cyclohexyl group. $R^{14}$ preferably represents an alkyl group having 4 carbon atoms or a cycloalkyl group having 6 carbon atoms because the solubility of the compound represented by the general formula (3) is high. $R^{15}$ represents an alkyl group having 1 to 20 carbon atoms, and examples thereof include the alkyl groups given as examples for the compound represented by the general formula (1). $R^{15}$ preferably represents an alkyl group having 1 to 4 carbon atoms because the solubility of the compound represented by the general formula (3) is high, and the number of carbon atoms is more preferably 1.

Component (E) is a compound represented by general formula (4).

[Chem. 22]

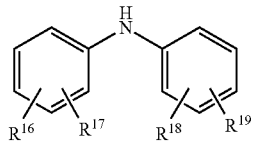

(4)

In the compound, $R^{16}$ to $R^{19}$ each independently represent a hydrogen atom or an alkyl group having 1 to 20 carbon atoms, and examples thereof include the alkyl groups given as examples for the compound represented by the general formula (1). $R^{16}$ to $R^{19}$ each preferably represent a hydrogen atom or an alkyl group having 1 to 12 carbon atoms because the improving effect on the solubility of the component (B) is high. When one or more of $R^{16}$ to $R^{19}$ of the compound represented by the general formula (4) have alkyl groups, positional isomers are obtained depending on bonding sites, but the isomers show substantially the same performance irrespective of their structures.

Component (F) is a compound represented by general formula (5),

[Chem. 23]

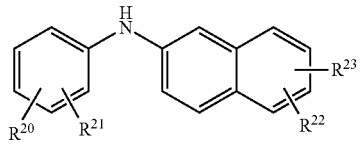

(5)

In the compound, $R^{20}$ to $R^{23}$ each represent a hydrogen atom or an alkyl group having 1 to 20 carbon atoms, and examples thereof include the alkyl groups given as examples for the general formula (1). $R^{20}$ to $R^{23}$ each preferably represent a hydrogen atom or an alkyl group having 1 to 12 carbon atoms because the improving effect on the solubility of the component (B) is nigh. When one or more of $R^{20}$ to $R^{23}$ of the compound represented by the general, formula (5) have alkyl groups, positional isomers are obtained depending on bonding sites, but the isomers snow substantially the same performance irrespective of their structures.

In the lubricating oil composition of the present invention, the component (B) is blended in an amount of 0.01 to 10 parts by mass, preferably 0.01 to 7 parts by mass, more preferably 0.02 to 5 parts by mass with respect to 100 parts by mass of the component (A). An excessively small blending amount is not preferred because the component may be unable to exert its effect as an anti-wear agent. An excessively large blending amount is not preferred because insoluble matter may appear or an effect commensurate with the blending amount cannot be obtained in some cases.

In addition, in the lubricating oil composition of the present invention, component (C), component (D), component (E) and component (F) are blended in a total amount of 0.01 to 10 parts by mass, preferably 0.05 to 7 parts by mass, more preferably 0.05 to 5 parts by mass with respect to 100 parts by mass of component (A), though the blending amount of component (C), component (D), component (E) and component (F) varies depending on the usage of component (B) and the kind of base oil. An excessively small blending amount is not preferred because a sufficient improving effect on the solubility of component (B) cannot be obtained in some cases. An excessively large blending amount is not preferred because an effect commensurate with the blending amount cannot be obtained in some cases.

Further, a known lubricating oil additive can also be added to the lubricating oil composition of the present invention. For example, lubricating oil additives such as an anti-wear agent other than component (B) to be used in the present invention, a friction modifier, a metal-based detergent, an ashless dispersant, an antioxidant, a friction-reducing agent, a viscosity index improver, a pour point depressant, a rust inhibitor, a corrosion inhibitor, an extreme pressure additive, an anti-foaming agent, a metal deactivator, an emulsifier, an anti-emulsifier, and an antifungal agent can also be added depending on the intended use as long as an effect of the present invention is not impaired.

Examples of the anti-wear agent include sulfur-based additives such as a sulfurized oil and fat, olefin polysulfide, and dibenzyl sulfide; phosphorus-based compounds such as monooctyl phosphate, tributyl phosphate, triphenyl phosphite, tributyl phosphite, and a thiophosphate; and organometal compounds such as a metal salt of thiophosphoric acid, a metal salt of thiocarbamic acid, a metal salt of an acidic phosphoric acid ester, and zinc dithiophosphate. Such anti-wear agent is blended in an amount of preferably 0.01 to 3 mass %, more preferably 0.05 to 2 mass % with respect to the component (A).

Examples of the friction modifier include: higher alcohols such as oleyl alcohol and stearyl alcohol; fatty acids such as oleic acid and stearic acid; esters such as oleyl glycerin ester, steryl glycerin ester, and lauryl glycerin ester; amides such as lauryl amide, oleyl amide, and stearyl amide; amines such as laurylamine, oleylamine, stearylamine, and an alkyldiethanolamine; and ethers such as lauryl glycerin ether and oleyl glycerin ether. Such friction modifier is blended in an amount of preferably 0.1 to 5 mass %, more preferably 0.2 to 3 mass % with respect to the component (A).

Examples of the metal-based detergent include sulfonates, phenates, salicylates, and phosphates of calcium, magnesium, and barium, and perbasic salts thereof. Of those, perbasic salts are preferred, and a perbasic salt having a total basic number (TBN) of 30 to 500 mgKOH/g out of the perbasic salts is more preferred. Such metal-based detergent is blended in an amount of preferably 0.5 to 10 mass %, more preferably 1 to 8 mass % with respect to the component (A).

Examples of the ashless dispersant include succinimide, a succinate, and benzylamine to each of which an alkyl group or an alkenyl group has been added and each of which has a weight-average molecular weight of about 500 to 3,000, and boron-denatured products thereof. Such ashless dispersant is blended in an amount of preferably 0.5 to 10 mass %, more preferably 1 to 8 mass % with respect to the component (A).

Examples of the antioxidant include: phenol-based antioxidants such as 2,6-ditertiary butylphenol (hereinafter, tertiary butyl is abbreviated to t-butyl), tris{(3,5-di-t-butyl-4-hydroxyphenyl)propionyl-oxyethyl}isocyanurate, tris(3,5-di-t-butyl-4-hydroxyphenyl)isocyanurate, 1,3,5-tris(3,5-di-t-butyl-4-hydroxybenzyl)isocyanurate, 1,3,5-tris(4-t-butyl-3-hydroxy-2,6-dimethylbenzyl)isocyanurate, 6-(4-hydroxy-3,5-di-t-butylanilino)-2,4-bis(octylthio)-1,3,5-triazine, 3,5-di-t-butyl-4-hydroxy-benzyl-phosphodiester, 3,9-bis-[1,1-dimethyl-2-{β-(3-t-butyl-4-hydroxy-5-methylphenyl) propionyloxy}ethyl]-2,4,8,10-tetraoxaspiro[5,5]undecane, and 1,1,3-tris(2-methyl-4-hydroxy-5-t-butylphenyl)butane; and phenothiazine-based antioxidants such as phenothiazine, N-methylphenothiazine, N-ethylphenothiazine, 3,7-dioctylphenothiazine, a phenothiazine carboxylate, and phenoselenazine. Such antioxidant is blended in an amount of preferably 0.01 to 5 mass %, more preferably 0.05 to 4 mass % with respect to the base oil.

Examples of the friction-reducing agent include organic molybdenum compounds such as sulfurized oxymolybdenum dithiocarbamate and sulfurized oxymolybdenum dithiophosphate. Such friction-reducing agent is blended in an amount of preferably 30 to 2,000 ppm by mass, more preferably 50 to 1,000 ppm by mass in terms of molybdenum content with respect to the component (A).

Examples of the viscosity index improver include a poly (C1 to C18) alkyl(meth)acrylate, a hydroxyethyl(meth)acrylate/(C1 to C18) alkyl(meth)acrylate copolymer, a diethylaminoethyl(meth)acrylate/(C1 to C18) alkyl(meth)acrylate copolymer, an ethylene/(C1 to C18) alkyl(meth)acrylate copolymer, a polyisobutylene, a polyalkylstyrene, an ethylene/propylene copolymer, a styrene/maleic acid ester copolymer, and a styrene/isoprene hydrogenated copolymer. Alternatively, a dispersion-type or multi-functional viscosity index improver to which dispersing performance has been imparted may be used. Its weight-average molecular weight is about 10,000 to 1,500,000, preferably about 20,000 to 500,000. Such viscosity index improver is blended in an amount of preferably 0.1 to 20 mass %, more preferably 0.3 to 15 mass % with respect to the component (A).

Examples of the pour point depressant include a polyalkyl methacrylate, a polyalkyl acrylate, a polyalkylstyrene, and a polyvinyl acetate. Its weight-average molecular weight is about 1,000 to 100,000, preferably about 5,000 to 50,000. Such pour point depressant is blended in an amount of preferably 0.005 to 3 mass %, more preferably 0.01 to 2 mass % with respect to the component (A).

Examples of the rust inhibitor include sodium nitrite, an oxidized paraffin wax calcium salt, an oxidised paraffin wax magnesium salt, a beef tallow fatty acid alkali metal salt, alkaline earth metal salt, or amine salt, an alkenyl succinic acid or an alkenyl succinic acid half ester (the molecular weight of the alkenyl group is about 100 to 300), a sorbitan mono-ester, nonylphenolethoxylate, and a lanolin fatty acid calcium salt. Such rust inhibitor is blended in an amount of preferably 0.01 to 3 mass %, more preferably 0.02 to 2 mass % with respect to the component (A).

Examples of the corrosion inhibitor include benzotriazole, benzimidazole, benzothiazole, benzothiadiazole, and a tetraethylthiuram disulfide. Such corrosion inhibitor is blended in an amount of preferably 0.01 to 3 mass %, more preferably 0.02 to 2 mass % with respect to the component (A).

Examples of the anti-foaming agent include a polydimethylsilicone, trifluoropropylmethylsilicone, colloidal silica, a polyalkyl acrylate, a polyalkylmethacrylate, an alcohol ethoxy/propoxylate, a fatty acid ethoxy/propoxylate, and a sorbitan partial fatty acid ester. Such anti-foaming agent is blended in an amount of preferably 0.001 to 0.1 mass %, mere preferably 0.001 to 0.01 mass % with respect to the component (A).

The lubricating oil composition of the present invention can be used in any application as long as the application is an application in which a lubricating oil can be used. Examples of such application include engine oils, lubricants for transmissions, gear oils, turbine oils, operating oils, refrigerating machine oils, compressor oils, vacuum pump oils, bearing oils, sliding surface oils, rock drill oils, metal cutting oils, plastic working oils, heat treatment oils, greases and processing oils.

EXAMPLES

Hereinafter, the present invention is specifically described by way of examples. It should be noted that the terms "%" and "ppm" in the following examples and the like refer to "mass %" and "ppm by mass," respectively unless otherwise stated.

Inventive and comparative products are described below.

Component (A)

A commercially available mineral oil (Super Oil N22 available from Nippon Oil Corporation: paraffin-based mineral oil, Viscosity Index: 102, Kinematic Viscosity at 100° C., 4.4 $mm^2$/sec)

Component (B)

<B-1>

A 1,000-ml four-necked flask provided with a stirring machine, a temperature gauge, and a nitrogen-introducing pipe was mounted with a condenser to which a water scrubber had been connected, and then 1.0 mol (110 g) of 1,3-benzenediol, 3.0 mol (460 g) of phosphorus oxychloride, and 0.005 mol (0.5 g) of magnesium chloride were loaded into the resultant reactor. The atmosphere in the reactor was replaced with nitrogen and then its temperature was gradually increased to 100° C. over 5 hours. After the mixture had been aged at the temperature for 2 hours, the pressure in the reactor was reduced and then the temperature was increased to 130° C. Excessive phosphorus oxychloride that had not been consumed in the reaction was removed by distillation. 4.0 Moles (376 g) of phenol were added to the reaction liquid and then the mixture was aged. Thus, the reaction was completed. After that, the catalyst was removed by an ordinary method and then the remainder was dried at 140° C. under reduced pressure. Thus, B-1 represented by general formula (22) was obtained.

[Chem. 24]

(22)

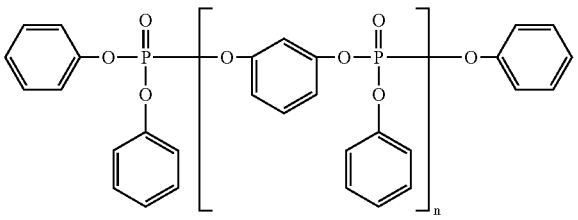

<B-2>

B-2 represented by general formula (23) was produced by the same production method as that of B-1 except that 4,4'-(propane-2,2-diyl)diphenol was used instead of 1,3-benzenediol in the synthesis of B-1.

[Chem. 25]

(23)

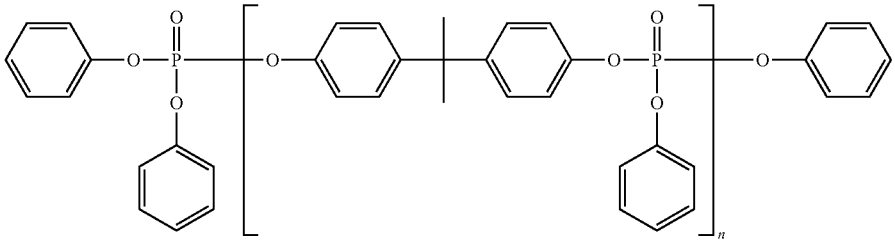

<B-3>

A 1,000-ml four-necked flask provided with a stirring machine, a temperature gauge, a dropping funnel, and a nitrogen-introducing pipe was mounted with a condenser to which a water scrubber had been connected, and then 2.0 mol (244 g) of 2,6-dimethylphenol, and 0.016 mol (1.5 g) of magnesium chloride were loaded into the resultant reactor. The atmosphere in the reactor was replaced with nitrogen and then its temperature was increased to 120° C. 1.0 Mole (153 g) of phosphorus oxychloride was dropped to the reactor at the temperature over 2 hours. After the completion of the dropping, the temperature was increased to 180° C. over 2 hours. Thus, di(2,6-xylyl)phosphorochloridate was obtained. The temperature in the flask was cooled to 20° C., and then 0.5 mol (55 g) of 1,3-benzenediol and 0.016 mol (1.5 g) of magnesium chloride were loaded into the flask. The temperature was increased to 180° C. over 2 hours and then the mixture was aged for 2 hours. After that, the catalyst was removed by an ordinary method and then the remainder was dried at 140° C. under reduced pressure. Thus, B-3 represented by general formula (24) was obtained.

[Chem. 26]

(24)

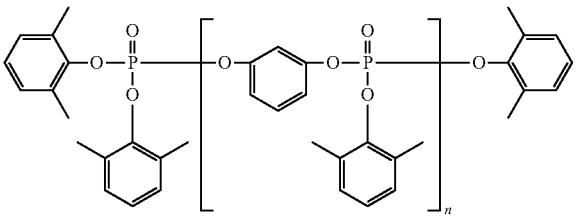

<B-4>

B-4 represented by general formula (25) was produced by the same production method as that of the B-1 except that 4,4'-biphenol was used instead of 1,3-benzenediol in the synthesis of B-1.

[Chem. 27]

(25)

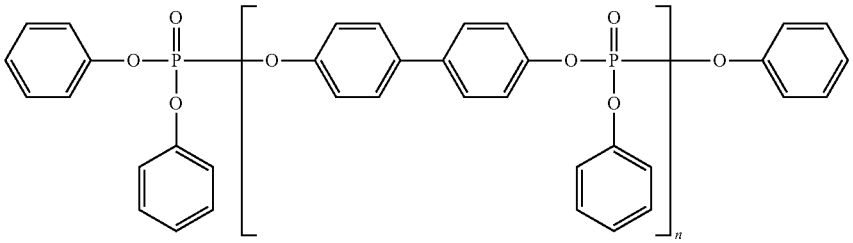

Table 1 below shows the composition and average degree of polymerization of each component (B).

TABLE 1

| Component (B) | General formula | Degree of polymerization (molar ratio) n = 1 | n = 2 | n = 3 to 10 | Average degree of polymerization |
|---|---|---|---|---|---|
| B-1 | General formula (22) | 74 | 18 | 8 | 1.4 |
| B-2 | General formula (23) | 91 | 8 | 1 | 1.1 |
| B-3 | General formula (24) | 95 | 4 | 1 | 1.06 |
| B-4 | General formula (25) | 88 | 11 | 1 | 1.1 |

Components (C) to (F)

X-1: manufactured by TOKYO CHEMICAL INDUSTRY CO., LTD., product name: 2,6-di-tert-butyl-p-cresol

[Chem. 28]

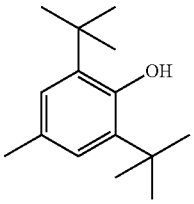

X-2: manufactured by TOKYO CHEMICAL INDUSTRY CO., LTD., product name: 2,2'-methylenebis(6-cyclohexyl-p-cresol)

[Chem. 29]

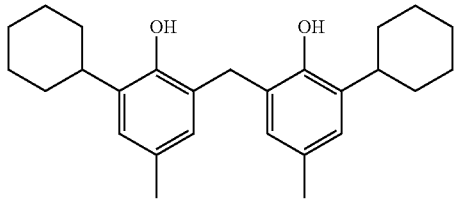

X-3: manufactured by ADEKA CORPORATION, product name: ADK STAB AO-50

[Chem. 30]

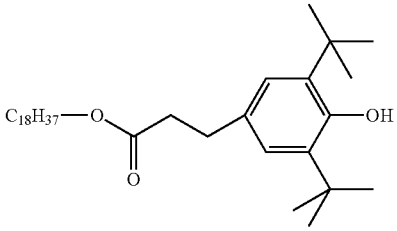

X-4: manufactured by Ciba Japan K.K., product name: IRGANOX L135

[Chem. 31]

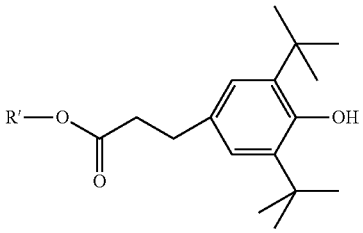

X-5: manufactured by TOKYO CHEMICAL INDUSTRY CO., LTD., product name: diphenylamine

[Chem. 32]

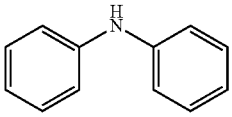

X-6: manufactured by Ciba Japan K.K., product name: IRGANOX L57

[Chem. 33]

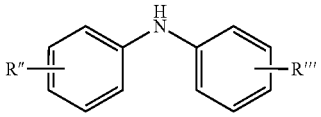

(R" and R'": mixtures of a hydrogen atom, a tertiary butyl group, and an octyl group)

X-7: manufactured by Ciba Japan K.K., product name: IRGANOX L06

[Chem. 34]

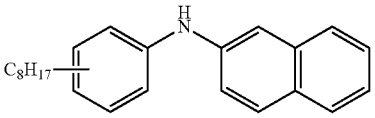

Comparative Additional Component

Y-1: manufactured by KANTO CHEMICAL CO., INC., product name: 4-nonylphenol

[Chem. 35]

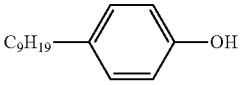

Y-2: manufactured by KANTO CHEMICAL CO., INC., product name: phenol

[Chem. 36]

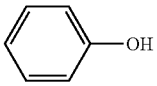

Y-3: manufactured by TOKYO CHEMICAL INDUSTRY CO., LTD., product name: 1,3,5-trimethylbenzene

[Chem. 37]

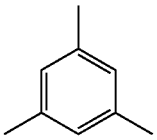

Y-4: manufactured by ADEKA CORPORATION, product name: ADEKA PROVER T-90

[Chem. 38]

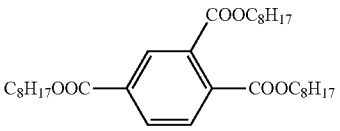

Y-5: manufactured by TOKYO CHEMICAL INDUSTRY CO., LTD., product name: aniline

[Chem. 39]

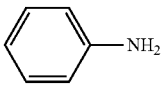

Y-6: manufactured by TOKYO CHEMICAL INDUSTRY CO., LTD., product name: p-toluidine

[Chem. 40]

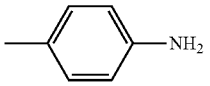

(Test Method)

100.0 Grams of component (A) and amounts shown in Table 2 or Table 3 of components (B) to (F) were loaded into a 200-ml beaker, and then the mixture was stirred at 90° C. for 1 hour. After the mixture had been left at rest at 25° C. for 20 hours, a wear resistance test was performed with a high-speed four-ball tester in conformity with ASTM D4172. The wear track diameter (mm) of a ball after the test was measured. A smaller wear track diameter means higher wear resistance. In addition, transmittance was measured under the following conditions. Component (B) was found to dissolve more uniformly as the transmittance at measurement wavelength increases.

Wear Resistance Test Conditions

Test instrument: Shell type high-speed four-ball tester

Number of rotations: 1,200 rpm

Load: 392 N

Test temperature: 75° C.

Test time: 60 minutes

Solubility Test Conditions

Measurement instrument: Spectrophotometer (Jasco Spectrophotometer B-530)

Measurement condition: 700 nm (optical path length: 1 cm, quartz cell)

TABLE 2

| | (A) | (B)[1] | (C to (F)[1] | Wear track diameter (mm) | Transmittance (700 mm) |
|---|---|---|---|---|---|
| Example 1-1 | A-1 | B-1 (0.2) | X-1 (0.5), X-6 (0.5) | 0.42 | 90 |
| Example 1-2 | A-1 | B-1 (0.2) | X-2 (0.5), X-6 (0.5) | 0.45 | 87 |
| Example 1-3 | A-1 | B-1 (0.2) | X-3 (0.5), X-6 (0.5) | 0.43 | 95 |
| Example 1-4 | A-1 | B-1 (0.2) | X-4 (0.5), X-6 (0.5) | 0.41 | 93 |
| Example 1-5 | A-1 | B-1 (0.2) | X-5 (1.0) | 0.42 | 98 |
| Example 1-6 | A-1 | B-1 (0.2) | X-7 (1.0) | 0.43 | 97 |
| Comparative Example 1-1 | A-1 | — | — | 0.76 | 100 |
| Comparative Example 1-2 | A-1 | B-1 (0.2) | — | 0.49 | 33 |
| Comparative Example 1-3 | A-1 | — | X-4 (0.5), X-6 (0.5) | 0.75 | 98 |
| Comparative Example 1-4 | A-1 | — | X-7 (1.0) | 0.75 | 97 |

[1]Values in ( ) of component (B) to component (F) represent addition amounts (g) with respect to 100 g of component (A).

TABLE 3

| | (A) | (B)[1] | (C) to (F)[1] | Wear track diameter (mm) | Transmittance (700 mm) |
|---|---|---|---|---|---|
| Example 2-1 | A-1 | B-2 (0.2) | X-4 (0.5), X-6 (0.5) | 0.43 | 92 |
| Example 2-2 | A-1 | B-2 (0.2) | X-7 (1.0) | 0.42 | 95 |
| Comparative Example 2-1 | A-1 | — | — | 0.76 | 100 |

TABLE 3-continued

| | (A) | (B)[1] | (C) to (F)[1] | Wear track diameter (mm) | Transmittance (700 mm) |
|---|---|---|---|---|---|
| Comparative Example 2-2 | A-1 | B-2 (0.2) | — | 0.54 | 30 |
| Comparative Example 2-3 | A-1 | — | X-4 (0.5), X-6 (0.5) | 0.75 | 98 |
| Comparative Example 2-4 | A-1 | — | X-7 (1.0) | 0.75 | 37 |

[1]Values in ( ) of component (B) to component (F) represent addition amounts (g) with respect to 100 g of component (A).

As can be seen from the results of the transmittance measurement, in the case where only B-1 or B-2 is added to A-1 (base oil), B-1 or B-2 does not dissolve when added in an amount of 0.2 part by mass, and hence a wear-reducing effect commensurate with the addition amount is not exerted. On the other hand, as can be seen from the results, even in the case where B-1 or B-2 is added in an amount of 0.2 part by mass to A-1, B-1 or B-2 dissolves when any one of X-1 to X-7 is added, and hence a wear-reducing effect commensurate with the addition amount is exerted.

There is a correlation between transmittance and wear-preventing effect because component (B) dissolves more uniformly and exerts a higher wear-preventing effect as turbidity reduces. Accordingly, the wear-preventing effect can be easily evaluated on the basis of the transmittance. A test result concerning the transmittance obtained by performing a solubility test is shown below.

(Test Method)

97.8 Grams of component (A), 0.2 g of component (B), and 2.0 g of components (C) to (F) were loaded into a 200-ml beaker, and then the mixture was stirred at 90° C. for 1 hour. After the mixture had been left at rest at 25° C. for 20 hours, transmittance for visible light was measured under the same conditions as those of Table 2 and Table 3. Table 4 shows the results.

TABLE 4

| | (A) | (B) | (C) to (F) | Transmittance (700 nm) |
|---|---|---|---|---|
| Exampel 1 | A-1 | B-1 | X-1 | 76 |
| Exampel 2 | A-1 | B-1 | X-2 | 62 |
| Exampel 3 | A-1 | B-1 | X-3 | 84 |
| Exampel 4 | A-1 | B-1 | X-4 | 76 |
| Exampel 5 | A-1 | B-1 | X-5 | 98 |
| Exampel 6 | A-1 | B-1 | X-6 | 98 |
| Example 7 | A-1 | B-1 | X-7 | 97 |
| Example 8 | A-1 | B-2 | X-3 | 82 |
| Exampel 9 | A-1 | B-2 | X-7 | 96 |
| Example 10 | A-1 | B-3 | X-3 | 80 |
| Example 11 | A-1 | B-3 | X-7 | 95 |
| Example 12 | A-1 | B-4 | X-3 | 85 |
| Comparative Example 1 | A-1 | B-1 | Y-1 | 30 |
| Comparative Example 2 | A-1 | B-1 | Y-2 | 32 |
| Comparative Example 3 | A-1 | B-1 | Y-3 | 46 |
| Comparative Example 4 | A-1 | B-1 | Y-4 | 34 |
| Comparative Example 5 | A-1 | B-1 | Y-5 | 33 |
| Comparative Example 6 | A-1 | B-1 | Y-6 | 33 |
| Comparative Example 7 | A-1 | — | Y-1 | 98 |
| Comparative Example 8 | A-1 | — | Y-2 | 99 |
| Comparative Example 9 | A-1 | — | Y-3 | 97 |
| Comparative Example 10 | A-1 | — | Y-4 | 98 |
| Comparative Example 11 | A-1 | — | Y-5 | 97 |
| Comparative Example 12 | A-1 | — | Y-6 | 97 |
| Comparative Example 13 | A-1 | B-1 | — | 33 |
| Comparative Example 14 | A-1 | B-2 | — | 33 |
| Comparative Example 15 | A-1 | B-3 | — | 28 |
| Example 16 | A-1 | B-4 | — | 24 |
| Comparative Example 17 | A-1 | — | — | 100 |

The invention claimed is:

1. A lubricating oil composition, comprising:

the following component (A) and component (B); and at least one selected from the following component (C), component (D), component (E), and component (F):

Component (A): mineral oil;

Component (B): a compound represented by the following formula (1):

(1)

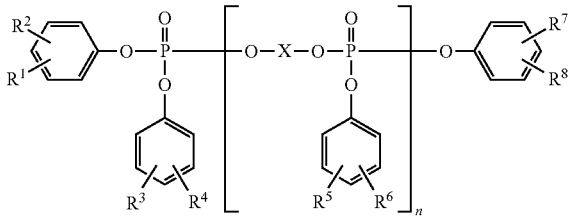

wherein $R^1$ to $R^8$ each independently represents a hydrogen atom or an alkyl group having 1 to 20 carbon atoms, X represents the formula (6), formula (7), or formula (8), and n represents a number of 1 to 10:

(6)

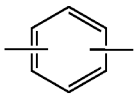

(7)

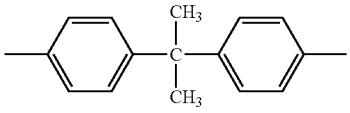

(8)

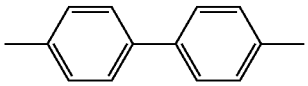

Component (C): a compound represented by the following formula (17), or formula (20):

(17)

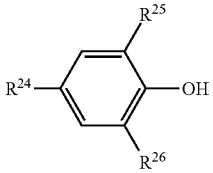

(20)

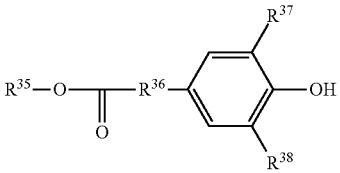

wherein $R^{24}$ represents an alkyl group having 1 to 20 carbon atoms, $R^{25}$ and $R^{26}$ each independently represent an alkyl group having 1 to 4 carbon atoms, $R^{35}$ represents an alkyl group having 1 to 24 carbon atoms, $R^{36}$ represents an alkyl group having 1 to 5 carbon atoms, and $R^{37}$ and $R^{38}$ each independently represent an alkyl group having 1 to 4 carbon atoms;

Component (D): a compound represented by the following formula (3):

(3)

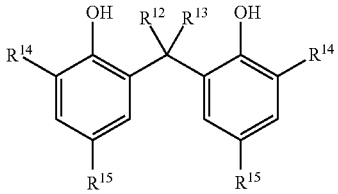

wherein $R^{12}$ and $R^{13}$ each independently represents a hydrogen atom or an alkyl group having 1 to 20 carbon atoms, $R^{14}$ represents an alkyl group having 1 to 6 carbon atoms or a cycloalkyl group having 6 carbon atoms, and $R^{15}$ represents an alkyl group having 1 to 20 carbon atoms;

Component (E): a compound represented by the following formula (4):

(4)

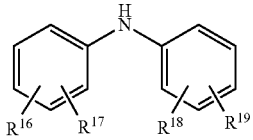

wherein $R^{16}$ to $R^{19}$ each independently represents a hydrogen atom or an alkyl group having 1 to 20 carbon atoms; and Component (F): a compound represented by the following formula (5):

(5)

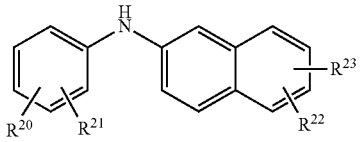

wherein $R^{20}$ to $R^{23}$ each independently represents a hydrogen atom or an alkyl group having 1 to 20 carbon atoms, and wherein, component (B) is blended in an amount of 0.02 to 5 parts by mass with respect to 100 parts by mass of component (A); and component (C), component (D), component (E), and/or component (F) are/is blended in a total amount of 0.05 to 5 parts by mass with respect to 100 parts by mass of component (A).

2. The lubricating oil composition according to claim 1, wherein the mineral oil as component (A) comprises at least one selected from a paraffin-based mineral oil, and a naphthene-based mineral oil.

3. The lubricating oil composition according to claim 1, wherein $R^1$ to $R^8$ in the formula (1) each represent a hydrogen atom or a methyl group.

4. The lubricating oil composition according to claim 1, further comprising at least one selected from the group consisting of an anti-wear agent except for the formula (1), a friction modifier, a metal-based detergent, an ashless dispersant, an antioxidant, a viscosity index improver, a pour point depressant, a rust inhibitor, a corrosion inhibitor, and an anti-foaming agent.

5. The lubricating oil composition according to claim 1, wherein the lubricating oil composition is engine oils, lubricating oils for transmissions, gear oils, turbine oils, operating oils, refrigerating machine oils, compressor oils, vacuum pump oils, bearing oils, sliding surface oils, rock drill oils, metal cutting oils, plastic working oils, heat treatment oils, greases, or processing oils.

* * * * *